US007573364B2

(12) United States Patent
Suzuki et al.

(10) Patent No.: US 7,573,364 B2
(45) Date of Patent: Aug. 11, 2009

(54) COIL UNIT

(75) Inventors: Hiroshi Suzuki, Tokyo (JP); Kazunori Arimitsu, Tokyo (JP); Yutaka Hatakeyama, Tokyo (JP); Hideki Sasaki, Tokyo (JP); Masaru Kumagai, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/000,416

(22) Filed: Dec. 12, 2007

(65) Prior Publication Data

US 2008/0143470 A1 Jun. 19, 2008

(30) Foreign Application Priority Data

Dec. 14, 2006 (JP) ..... 2006-336647

(51) Int. Cl.
*H01F 27/28* (2006.01)

(52) U.S. Cl. ..... 336/229; 336/208; 336/192

(58) Field of Classification Search ..... 336/229, 336/65, 90, 208
See application file for complete search history.

(56) References Cited

U.S. PATENT DOCUMENTS 5,353,494 A * 10/1994 Bisbee et al. ..... 29/605
6,300,857 B1 * 10/2001 Herwig ..... 336/229
6,507,260 B1 * 1/2003 Baumann et al. ..... 336/90

FOREIGN PATENT DOCUMENTS

| | | |
|---|---|---|
| JP | U-47-14617 | 10/1972 |
| JP | U-56-85917 | 12/1979 |
| JP | U-62-170613 | 10/1987 |
| JP | U-63-140609 | 9/1988 |
| JP | U-4-52717 | 5/1992 |
| JP | A-4-294510 | 10/1992 |
| JP | A-5-275253 | 10/1993 |
| JP | A 5-275253 | 10/1993 |
| JP | U-6-2637 | 1/1994 |
| JP | U-7-18408 | 3/1995 |
| JP | A-11-162745 | 6/1999 |
| JP | A-2005-142320 | 6/2005 |

* cited by examiner

*Primary Examiner*—Elvin G Enad
*Assistant Examiner*—Joselito Baisa
(74) *Attorney, Agent, or Firm*—Oliff & Berridge, PLC

(57) ABSTRACT

A coil unit including an annular toroidal core, two coils wound over the toroidal core providing a bifilar winding, a winding-start positioning part, and a winding-end positioning part. The winding-start positioning part is adapted for making contact with a winding-start portion of the coils. The winding-end positioning part is adapted for making contact with a winding-end portion of the coils for regulating the positions of the winding-start portion and the winding-end portion relative to the toroidal core.

4 Claims, 9 Drawing Sheets

COIL UNIT

BACKGROUND ART

The present invention relates to a coil unit, and more particularly, to a coil unit including a toroidal core and a bifilar coil wound over the core. The bifilar coil is an electromagnetic coil that contains two closely spaced, parallel windings.

A common-mode noise filter has been known as a coil unit including a toroidal core and a bifilar winding mounted on the core. In the coil unit, the toroidal core is shaped as designed, and the windings constituting the bifilar winding have a designated number of turns each extending for prescribed path distances and being led out at specified position, so that produced coil units can acquire uniform characteristics such as resonance frequency characteristic to one another. Such conventional coil unit is described in laid-open Japanese Patent Application Publication No. 5-275253.

As the technology advances, more precise control to signals flowing through an electronic device is required. Hence, noise should be removed from the signals at high precision. The conventional coil units have provided improved precision, but variation in characteristics is still recognized. Before using a conventional coil unit in order to remove noise from signals at high precision, the characteristics of each coil unit need to be checked, and coil units must be selectively used dependent on difference in electronic device.

SUMMARY

It is therefore, an object of the present invention to provide a coil unit having a consistent design characteristic with less variation in characteristic among a plurality of coil units.

This and other object of the present invention will be attained by a coil unit including a toroidal core, two coils, and a positioning portion. The toroidal core has an annular shape. The two coils are wound over the toroidal core in a circumferential direction thereof to form a bifilar winding. The coils have a winding-start portion and a winding-end portion with respect to the toroidal core. The positioning portion defines a winding-start positioning part and a winding-end positioning part each in contact with the bifilar winding at the winding-start portion and the winding-end portion, respectively.

EMBODIMENTS

Figure 1:
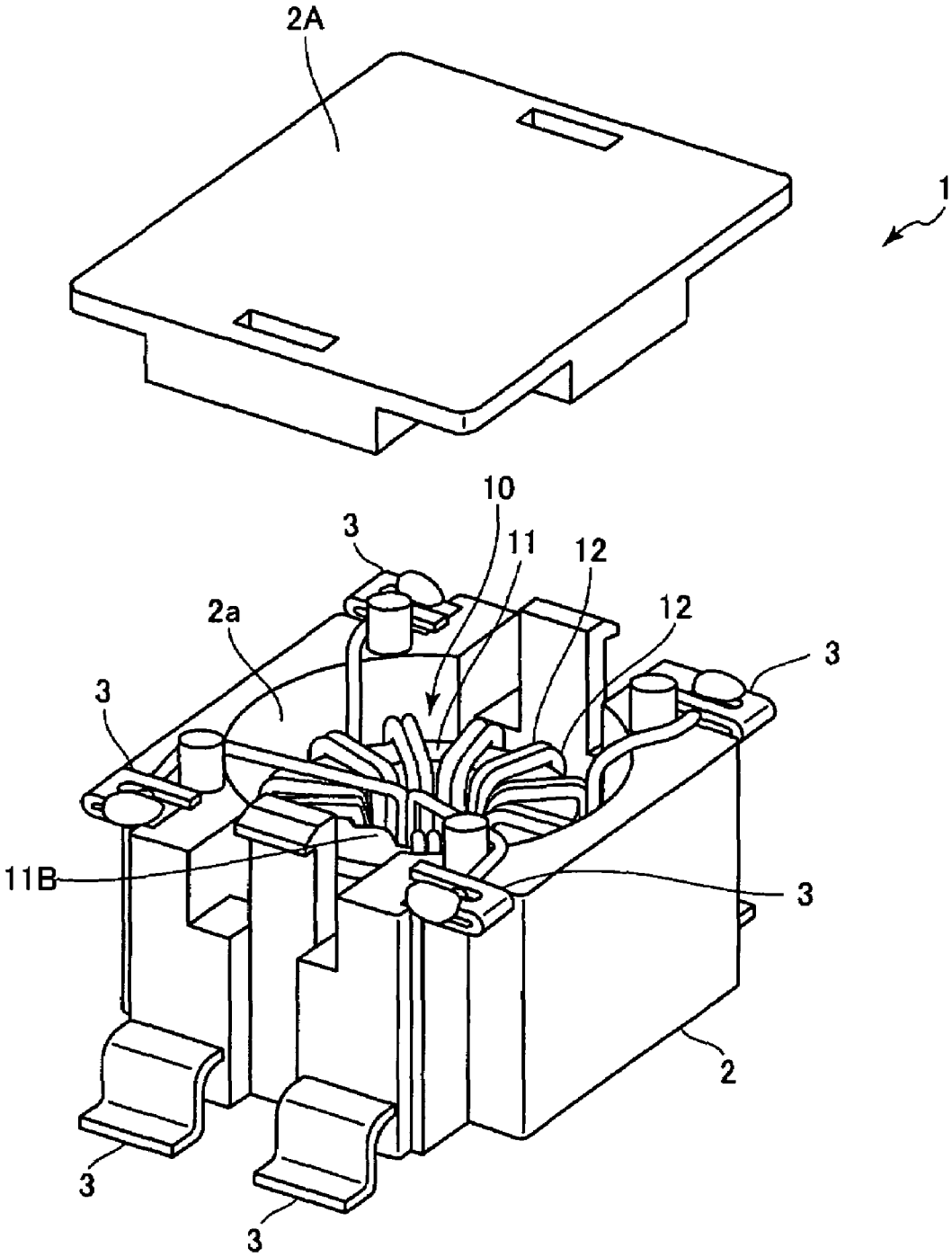
FIG. 1 is an exploded perspective view of a coil unit according to a first embodiment of the present invention.

A coil unit according to a first embodiment of the present invention will be described with reference to FIGS. 1 to 4. The coil unit 1 shown in FIG. 1 is a common-mode choke coil and includes a coil winding portion 10 and a case 2 made from a resin.

Figure 2:
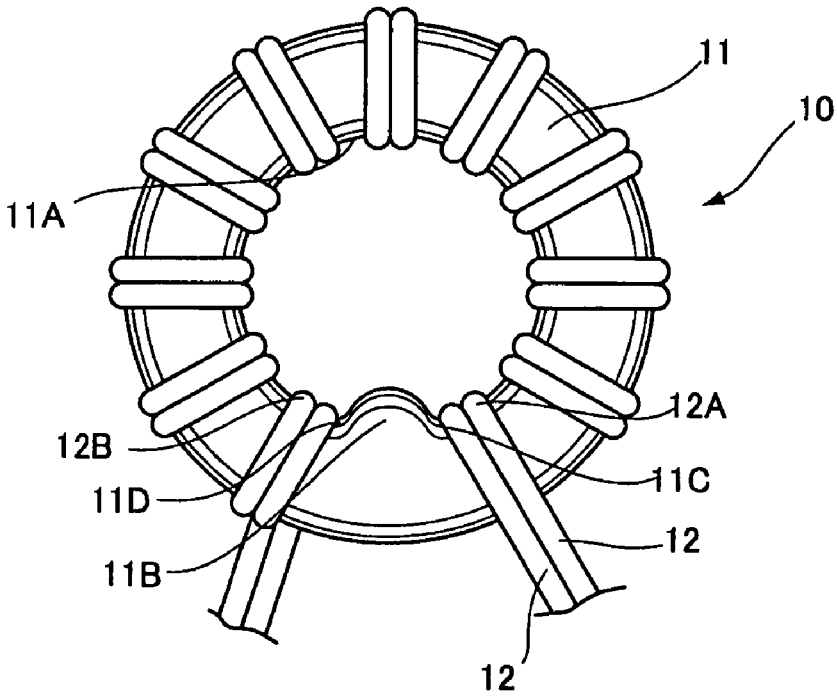
FIG. 2 is a plan view of a coil winding portion of the coil unit according to the first embodiment.
Figure 3:
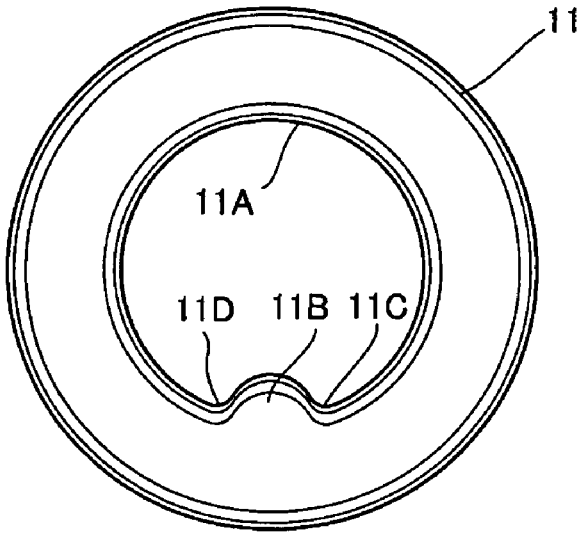
FIG. 3 is a plan view of a toroidal core of the coil unit according to the first embodiment.

As shown in FIG. 2, the coil winding portion 10 includes an annular toroidal core 11 and two coils 12, 12 each covered with an insulating coating. The toroidal core 11 is made mainly from ferrite. As shown in FIG. 3, the toroidal core 11 is shaped like a hollow cylinder. A projection 11B protrudes radially inwardly from an inner peripheral surface 11A of the toroidal core 11. The projection 11B protrudes toward the center of the toroidal core 11. The projection 11B is formed integrally with the toroidal core 11 upon molding the toroidal core 11. This simplifies the formation of the projection 11B.

The projection 11 has a base end at the inner peripheral surface 11A. The base end has one side 11C and another side 11D spaced away from one side 11C in the circumferential direction of the toroidal core 11. The one side 11C defines a winding-start positioning part 11C. The other side 11D defines a winding-end positioning part 11D.

The coils 12 are polyamideimide wires (AIWs), each being a conductor wire covered with an insulating coating. As shown in FIG. 2, for winding the coils 12 over the toroidal core 11, the winding-start parts 12A of the coils 12 are led or latched to the winding-start positioning part 11C from the above position of the troidal core 11 in the direction perpendicular to the drawing sheet of FIG. 2. The winding-start parts 12A are then held at the winding-start positioning part 11C. The winding-start parts 12A can be accurately positioned or regulated with respect to the toroidal core 11. After the winding-start parts 12A have been positioned, the coils 12 are wound over the toroidal core 11, providing a bifilar winding.

The coils 12 are wound over the toroidal core 11 until the winding-end parts 12B of the coils 12 are held at the winding-end positioning part 11D of the toroidal core 11. The winding-end parts 12B can be positioned accurately with respect to the toroidal core 11. The winding-end parts 12B are then led at the winding-end positioning part 11D from below the toroidal core 11, in the direction perpendicular to the drawing sheet of FIG. 2. Thus, the coils 12 are completely wound over the toroidal core 11.

In the coil winding portion 10, the winding-start positioning part 11C and the winding-end positioning part 11D are located at the one and other sides 11C and 11D of the base end of the projection 11B of the toroidal core 11. The winding-start part 12A and winding-end part 12B of the coils 12 are therefore held or latched at the winding-start positioning part 11C and winding-end positioning part 11D, and are spaced apart by the length of the base end of the projection 11B.

Hence, direct contact between the winding-start part 12A and winding-end part 12B of the coils 12 can be prevented or restrained.

The case 2 is mainly made from a resin and is shaped like a rectangular parallelepiped as shown in FIG. 1. The case 2 has a columnar recess 2*a* open to a top surface and at a center portion of the case 2. The coil winding portion 10 is accommodated in the recess 2*a* coaxially therewith.

The case 2 has metal terminals 3 to which ends of the coils 12 are electrically and mechanically connected. As shown in FIG. 1, four metal terminals 3 are fixed to the case 2, so that each one end of the coils 12, 12 is connected to each of the two metal terminals 3, and each another end of the coils 12, 12 is connected to each of the remaining two metal terminals 3. These metal terminals are fixed to the case 2 upon molding the case 2 in such a manner that each metal terminal 3 has a part embedded in the molten resin mass during molding the case 2. Thus, the metal terminals 3 are formed integral with the case 2 and are secured to the case 2. Each of the metal terminals 3 has an upper exposed part at the top surface of the case 2 where the recess 2*a* is open. Each of the ends of the coils 12, 12 is joined and fixed to the upper exposed part. The case 2 has a protection cover 2A that covers the open end of the recess 2*a* and protects the fixing or joining parts between the ends of the coils 12, 12 and the metal terminals 3.

A coil unit according to a modification to the first embodiment will be described with reference to FIGS. 4 and 5. The coil unit has a coil winding portion 20 identical to the coil winding portion 10 except for first and second projections 21B and 21C. The coil unit has a case identical to that of the first embodiment, and therefore, further description of the case will be omitted.

The coil winding portion 20 includes a toroidal core 21 and coils 22. The toroidal core 21 is mainly made from ferrite and has an annular shape. First and second projections 21B and 21C are provided on an inner peripheral surface 21A of the toroidal core 21. These projections 21B, 21C protrude toward a center of the toroidal core 21.

The first projection 21B has one side 21D of a base end, the one side being positioned close to the second projection 21C, and the second projection 21C has one side 21E of a base end, the one side 21E being positioned close to the first projection 21B. The one side 21D serves as a winding-start positioning part 21D, and one side 21E serves as a winding-end positioning part 21E. A minimum distance in the circumferential direction of the toroidal core 21 between the winding-start positioning part 21D and winding-end positioning part 21E is less than four times of a diameter of the single coil 22.

The coils 22 are identical to the coils 12 of the first embodiment. To wind the coils 22 over the toroidal core 21, winding-start parts 22A of the coils 22 are led to the winding-start positioning part 21D from above the toroidal core 21 in the direction perpendicular to the drawing sheet of FIG. 5. Thus, the winding-start parts 22A can be positioned accurately with respect to the toroidal core 21. After the winding-start parts 22A have been so positioned, the coils 22 are wound over the toroidal core 21, providing a bifilar winding. The coils 22 are wound over the toroidal core 21 the same number of times as in the coil winding portion 10 according to the first embodiment.

The coils 22 are wound over the toroidal core 21 until the winding-end parts 22B of the coils 22 are held at the winding-end positioning part 21E of the toroidal core 21. Thus, the winding-end parts 22B can be positioned accurately with respect to the toroidal core 21. The winding-end parts 22B are then led at the winding-end positioning part 21E from below the toroidal core 21, in the direction perpendicular to the drawing sheet of FIG. 5. Thus, the coils 22 are completely wound over the toroidal core 21.

As described above, in the coil winding portion 20, the winding-start positioning part 21D and the winding-end positioning part 21E are provided at the sides 21D and 21E of the base ends of the projections 21B, 21C, respectively, which are close to each other. Thus, a distance between the winding-start positioning part 21D and the winding-end positioning part 21E can be made shorter than four times the diameter of the single coil 22. The winding-start parts 22A and winding-end parts 22B are arranged between the winding-start positioning part 21D and the winding-end positioning part 21E. Since the winding-start parts 22A and winding-end parts 22B are composed of two coils 22, four coils are arranged between the winding-start positioning part 21D and the winding-end positioning part 21E. In other words, four coils are arranged in a gap whose width is less than four times their diameter. Accordingly, at least one coil is superposed with at least one remaining one of the coils in the gap. Hence, a remote spacing between the winding-start parts 22A and winding-end parts 22B can be avoided or restrained.

Figure 4:
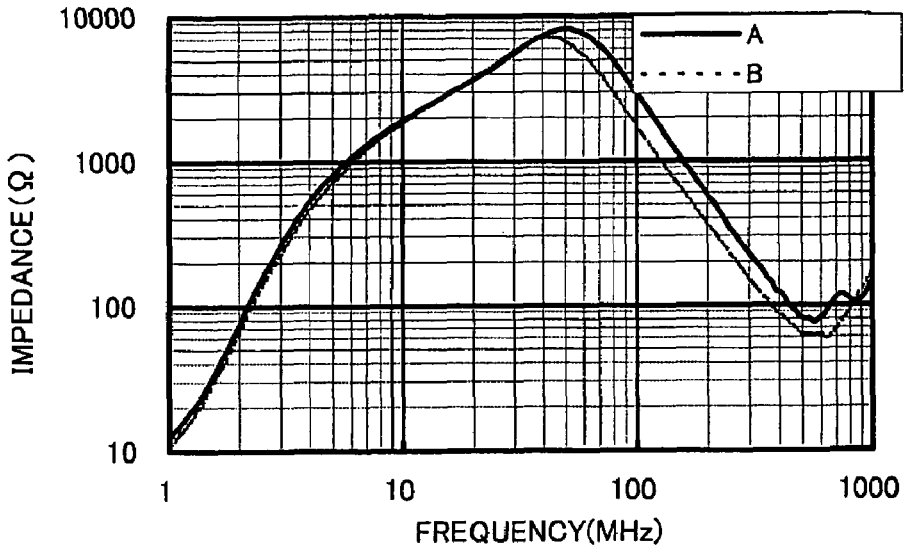
FIG. 4 is a graph representing resonance frequency characteristics of the coil unit according to the first embodiment and a coil unit according to a modification to the first embodiment.
Figure 5:
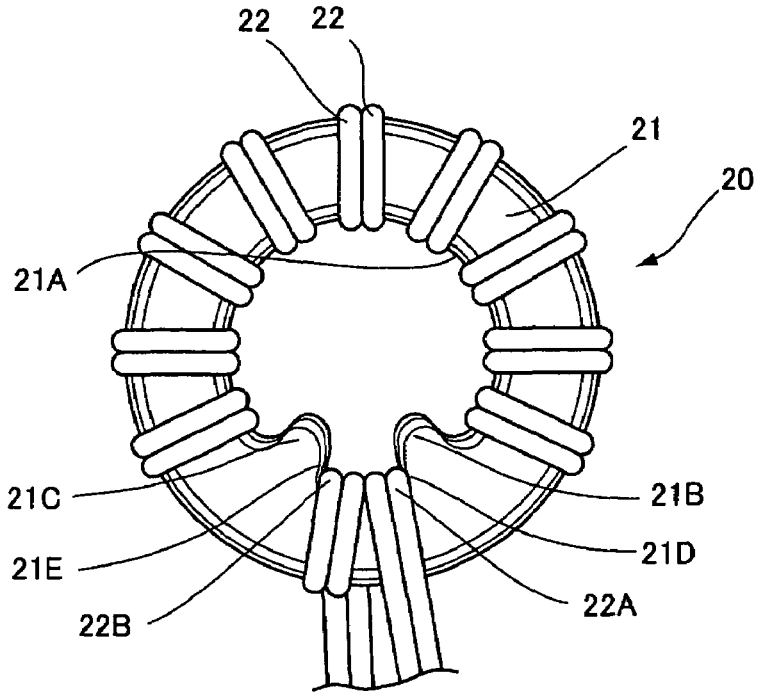
FIG. 5 is a plan view of a coil winding portion of the coil unit according to the modification to the first embodiment.

The coil winding portions 10, 20 of the coil unit 1 according to the first embodiment and the modification thereto provide the relationship between a resonance frequency and impedance as represented in the graph of FIG. 4 where a solid line A represents the coil winding portion 10 of the first embodiment, and a broken line B represent a coil winding according to the modification to the first embodiment.

According to the graph in FIG. 4, a comparison is made between the coil winding portion 10 in which the winding-start parts and the winding-end parts are spaced away from each other and the coil winding portion 20 in which the winding-start parts and the winding-end parts are in contact with each other. In the comparison, no significant difference can be recognized in terms of impedance in the low frequency region. However, in the high frequency region, the coil winding portion 10 has impedance higher than that of the coil winding portion 20. Therefore, these coil winding portions 10 and 20 can be used selectively in a circuit where noise of high frequency is generated. Consequently, the apparatus incorporating the coil unit can more satisfy the design specification of the apparatus the selection.

Figure 6:
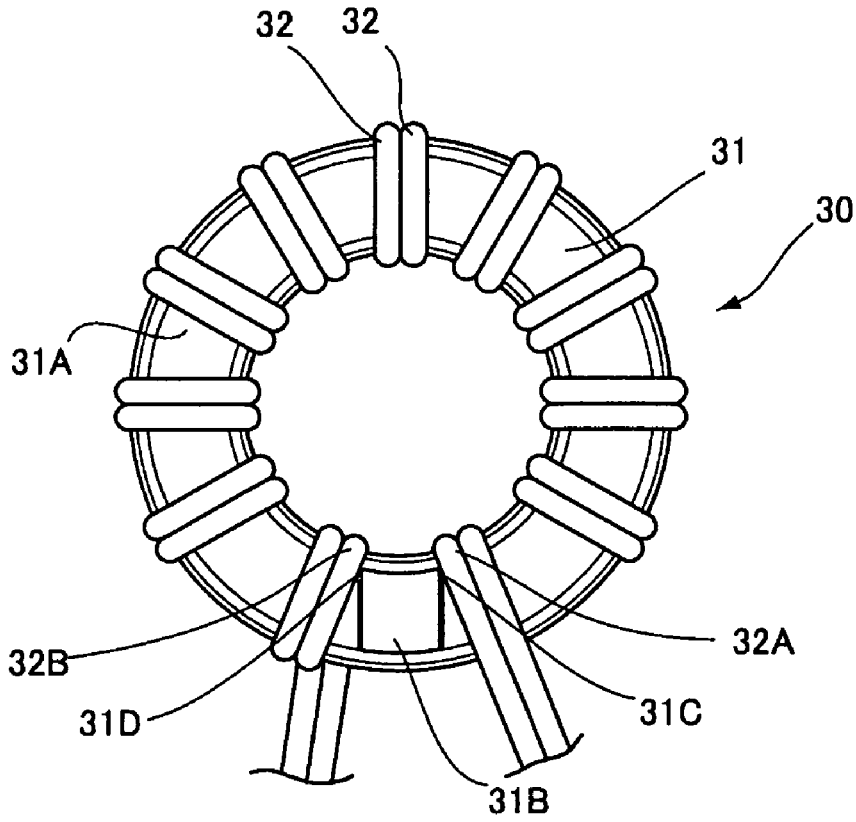
FIG. 6 is a plan view of a coil winding portion of a coil unit according to a second embodiment of the present invention.
Figure 7:
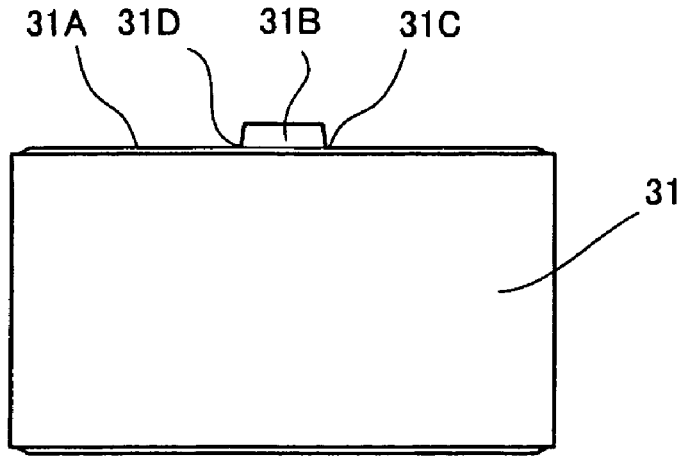
FIG. 7 is a side view of a toroidal core of the coil unit according to the second embodiment.

A coil unit according to a second embodiment of the present invention will be described with reference to FIGS. 6 and 7. The coil unit has a coil winding portion 30 having an outer diameter equal to that of the coil winding portion 10 of the first embodiment. Further, a case accommodating the coil winding portion 30 is the same as that of the first embodiment.

The coil winding portion 30 includes a toroidal core 31 and two coils 32. The toroidal core 31 is mainly made from ferrite and is shaped like a hollow cylinder. The toroidal core 31 has an end face 31A extending perpendicular to an axis of the toroidal core 31. A single projection 31B protrudes from the end face 31A in the axial direction of the toroidal core 31. Since the projection 31B is formed integral with the toroidal core 31, the projection 31B can be formed concurrently with the molding of the toroidal core 31. This simplifies the formation of the projection 11B. The single projection 31 has two sides 31C and 31D spaced apart from each other in the circumferential direction of the toroidal core 31. The one side 31C serves as a winding-start positioning part 31C, and the other side 31D serves as a winding-end positioning part 31D.

The coils 32 are identical to the coils 12 in the first embodiment. To wind the coils 32 over the toroidal core 31, the winding-start parts 32A of the coils 32 are led to the winding-start positioning part 31C from a radially outer side toward a radially inner side of the core 31 as is illustrated in FIG. 6.

Winding-start parts 32A of the coils 32 are then held at the winding-start positioning part 31C. The winding-start parts 32A are therefore accurately positioned with respect to the toroidal core 31. After the winding-start parts 32A have been so positioned, the coils 32 are wound over the toroidal core 31, providing a bifilar winding.

The coils 32 are wound over the toroidal core 31 until winding-end parts 32B of the coils 32 are held at the winding-end positioning part 31D of the toroidal core 31. The winding-end parts 32B are therefore accurately positioned with respect to the toroidal core 31. The coils 32 are then directed to another end face opposite to the end face 31A, and are pulled from the other end face of the core 31. Thus, the coils 32 are completely wound over the toroidal core 31.

In the coil winding portion 30, the winding-start positioning parts 31C and the winding-end positioning part 31D are located at the one and other sides 31C and 31D of the projection 31 of the toroidal core 31, respectively. The winding-start part 32A and winding-end part 32B of the coils 32 are therefore held at the winding-start positioning part 31C and winding-end positioning part 31D and are spaced apart from each other by the mass of the projection 31B. Hence, direct contact between the winding-start part 32A and winding-end part 32B can be prevented.

Figure 8:
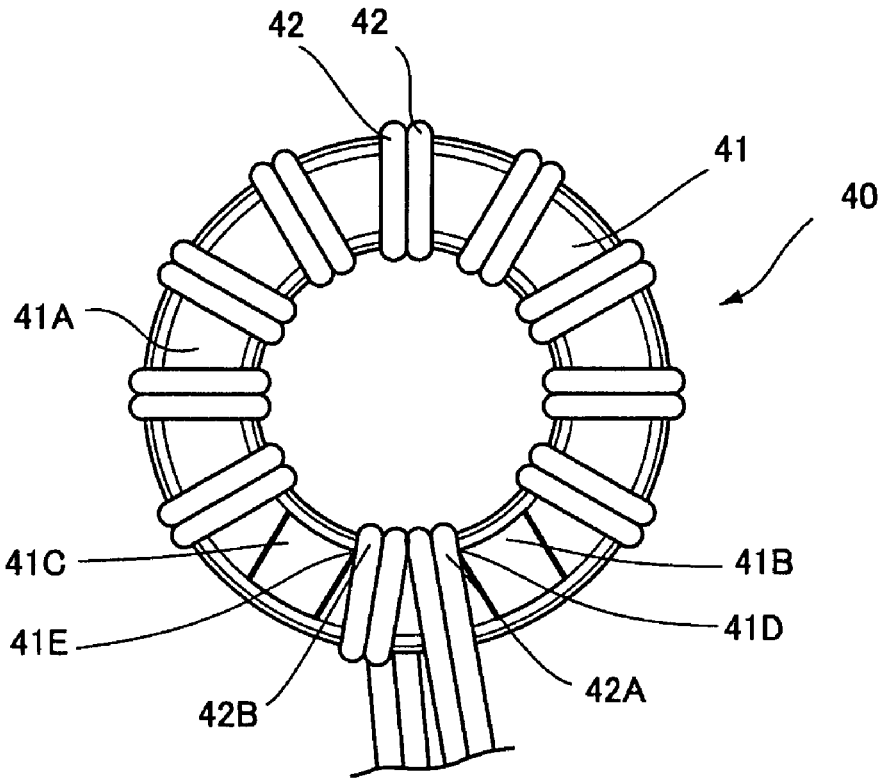
FIG. 8 is a plan view of a coil winding portion of a coil unit according to a modification to the second embodiment.
Figure 9:
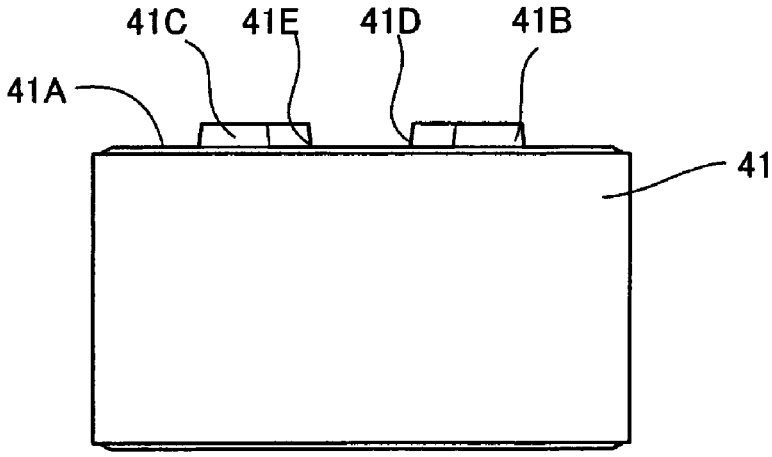
FIG. 9 is a side view of a toroidal core of the coil unit according to the modification to the second embodiment.

A coil unit according to a modification to the second embodiment will be described with reference to FIGS. 8 and 9. The coil unit has a coil winding portion 40 having an outer diameter equal to that of the coil winding portion 10 of the first embodiment. Further, coil unit has a case identical to that of the first embodiment.

The coil winding portion 40 includes a toroidal core 41 and two coils 42. The toroidal core 41 is mainly made from ferrite and is shaped like a hollow cylinder. The toroidal core 41 has an axial end face 41A extending in a direction perpendicular to an axis of the core 41. First and second projections 41B and 41C protrude in the axial direction from the end face 41A.

The first projection 41B has a side face 41D positioned close to the second projection 41C and serving as a winding-start positioning part 41D, and the second projection 41C has a side face 41E positioned close to the first projection 41B and serving as a winding-end positioning part 41E. The shortest distance between the winding-start positioning part 41D and the winding-end positioning part 41E, measured in the circumferential direction of the toroidal core 41, is less than four times the diameter of the single coil 42.

The coils 42 are identical to the coils 12 of the first embodiment. To wind the coils 42 over the toroidal core 41, the winding-start parts 42A of the coils 42 are held at the winding-start positioning part 41C in such a manner that a winding-start parts 42A of the coils 42 extend from a radially outer side to a radially inner side of the toroidal core 41. Thus, the winding-start parts 42A can be accurately positioned with respect to the toroidal core 41. After the winding-start parts 42A have been so positioned, the coils 42 are wound over the toroidal core 41, providing a bifilar winding.

The coils 42 are wound over the toroidal core 41 until the winding-end parts 42B of the coils 42 are held at the winding-end positioning part 41E of the toroidal core 41. The winding-end parts 42B can be positioned accurately with respect to the toroidal core 41. The coils 42 are then directed to another end face which is opposite to the end face 41A, and are pulled radially outwardly. Thus, the coils 42 are completely wound over the toroidal core 41.

In the coil winding portion 40, four coils 42 are disposed in a gap whose width is less than four times the diameter of the single coil, similar to the modification to the first embodiment. Therefore, the winding-start parts 42A and winding-end parts 42B are held in contact with each other in such a manner that at least one of the coils overlaps with at least one of the remaining coils. Hence, remote spacing between the winding-start parts 42A and the winding-end parts 42B does not occur.

Figure 10:
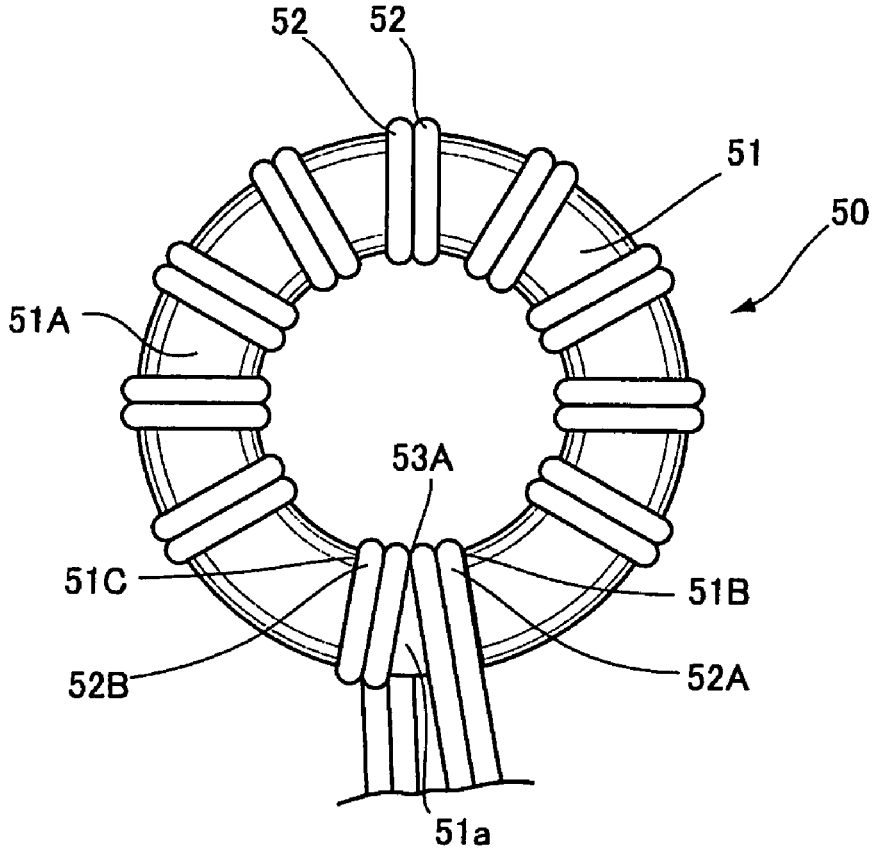
FIG. 10 is a plan view of the coil winding portion of a coil unit according to a third embodiment of the present invention.
Figure 11:
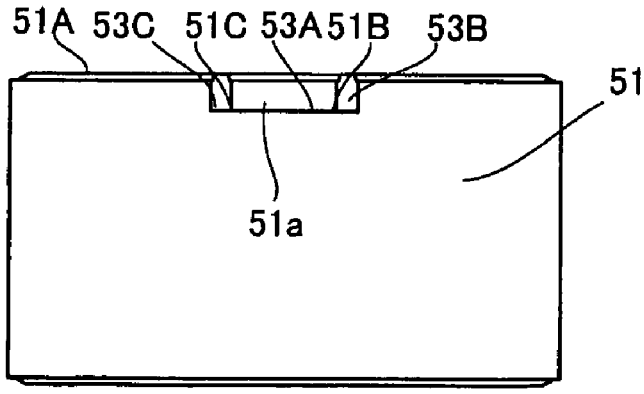
FIG. 11 is a side view of a toroidal core of the coil unit according to the third embodiment.

FIGS. 10 and 11 show a coil unit according to a third embodiment of the present invention. This coil unit has a coil winding portion 50 as shown in FIG. 10. The coil winding portion 50 has a diameter equal to that of the coil winding portion 10 of the first embodiment. Further, the coil unit has a case identical with that of the first embodiment.

The coil winding portion 50 includes an annular toroidal core 51 and two coils 52. Ferrite is the main material of the toroidal core 51. The toroidal core 51 has an axial end face 51A that extends in a direction perpendicular to an axis thereof. A positioning groove 51*a* is formed on the end face 51A. The positioning groove 51*a* extends in a radial direction of the toroidal core 51 and has one end open to an inner peripheral surface of the toroidal core 51 and another end open to an outer peripheral surface thereof. Further, the positioning groove 51*a* has groove walls 53B, 53C and a bottom wall 53A.

As shown in FIG. 11, a winding-start positioning part 51B is defined at an intersection of the bottom wall 53A and the side wall 53B. Similarly, a winding-end positioning part 51C is defined at an intersection of the bottom wall 53A and the side wall 53C. The shortest distance from the winding-start positioning part 51B to the winding-end positioning part 51C, measured in the circumferential direction of the toroidal core 51, is less than four times the diameter of the single coil 52.

The coils 52 are identical to the coils 12 of the first embodiment. To wind the coils 52 over the toroidal core 51, the winding-start parts 52A of the coils 52 are positioned over the bottom wall 53 in such a manner that coils 52 extend radially inwardly. Then, the winding-start parts 52A are held at the winding-start positioning part 51B. Thus, the winding-start parts 52A can be positioned accurately with respect to the toroidal core 51. After the winding-start parts 52A have been so positioned, the coils 52 are wound over the toroidal core 51, providing a bifilar winding.

The coils 52 are wound over the toroidal core 51 until the winding-end parts 52B of the coils 52 are held at the winding-end positioning part 51C of the toroidal core 51. Thus, the winding-end parts 52B can be positioned accurately with respect to the toroidal core 51. Then, the coils 52 are directed to another end face opposite to the end face 51A, and are pulled radially outwardly. Thus, the coils 52 are completely wound over the toroidal core 51.

In the coil winding portion 50, four coils 52 are arranged in a groove gap whose width is less than four times the diameter of the single coil, similar to the modification to the first embodiment. Therefore, the winding-start parts 52A and winding-end parts 52B are held in such a manner that at least one of the coils overlaps with the other coil. Hence, remote spacing between the winding-start parts 52A and winding-end parts 52B can be prevented.

Figure 12:
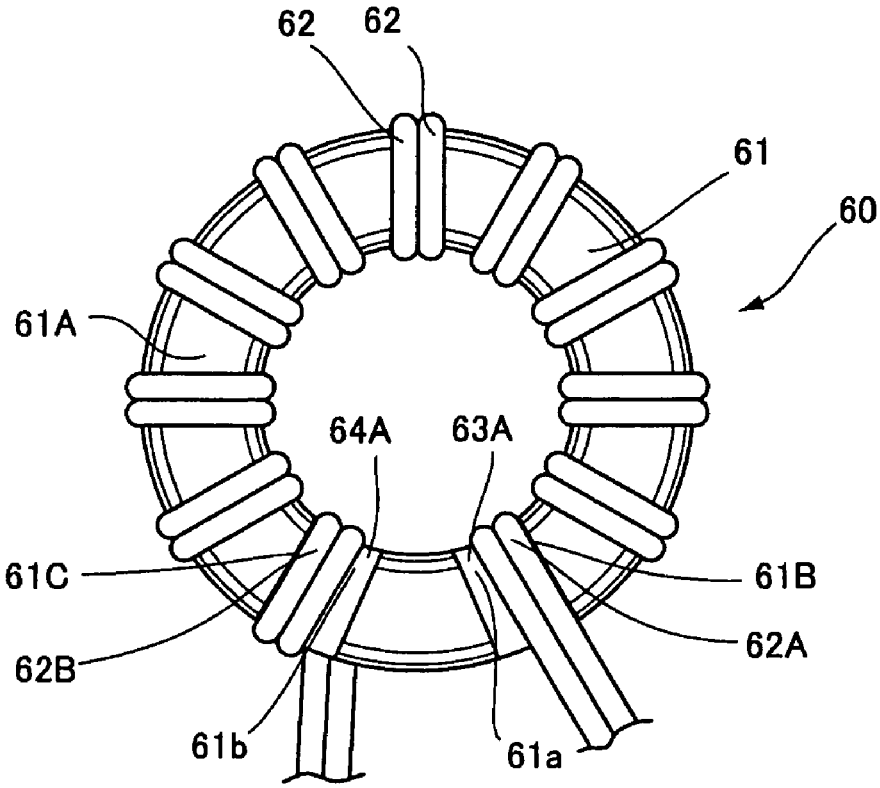
FIG. 12 is a plan view of a coil winding portion of a coil unit according to a modification to the third embodiment.
Figure 13:
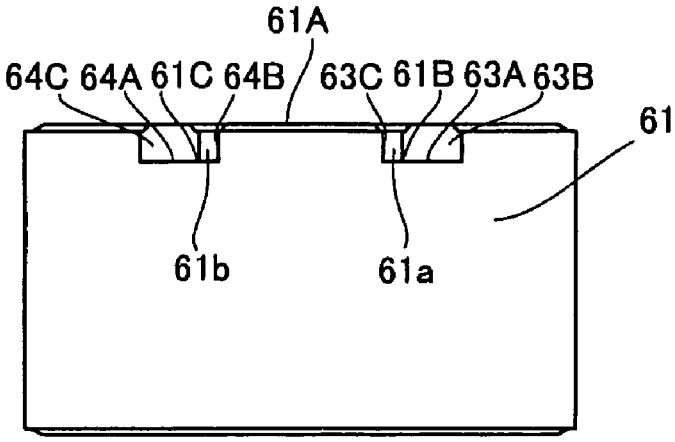
FIG. 13 is a side view of a toroidal core of the coil unit according to the modification to the third embodiment.

A coil unit according to a modification to the third embodiment will be described with reference to FIGS. 12 and 13. FIG. 12 shows the coil winding portion 60 of the modified coil unit. The coil winding portion 60 has an outer diameter the same as that of the coil winding portion 10 of the first embodiment. The coil unit has a case identical to the case of the first embodiment.

The coil winding portion 60 includes an annular toroidal core 61 mainly made from ferrite and two coils 6. The toroidal core 61 has an axially end face 61A that extends in a direction perpendicular to an axis of the core 61. In the end face 61A, first and second positioning grooves 61*a* and 61*b* are formed each extending in a radial direction of the toroidal core 61. One end of each groove is open to an inner peripheral surface of the toroidal core, and another end of each groove is open to an outer peripheral surface thereof.

The first positioning groove 61*a* is defined by a bottom wall 63A and side walls 63B and 63C. The side wall 63B is spaced away from the second positioning groove 61*b*, whereas the side wall 63C is close to the second positioning groove 61*b*. A winding-start positioning part 61B is defined at the intersection of the bottom wall 63A and the side wall 63B.

The second positioning groove 61*b* is defined by a bottom wall 64A and side walls 64B and 64C. The side wall 64B is close to the first positioning groove 61*a*, whereas the side wall 64C is spaced away from the first positioning groove 61*a*. A winding-end positioning part 61C is defined at the intersection of the bottom wall 64A and the side wall 64C.

The coils 62 are identical to the coils 12 of in the first embodiment. To wind the coils 62 over the toroidal core 61, the winding-start parts 62A of the coils 62 are positioned over the bottom wall 63A in such a manner that coils 62 extends radially inwardly, and the winding-start parts 62A is held at the winding-start positioning part 61B. Thus, the winding-start parts 62A can be accurately positioned with respect to the toroidal core 61. After the winding-start parts 62A have been so positioned, the coils 62 are wound over the toroidal core 61, providing a bifilar winding.

The coils 62 are wound over the toroidal core 61 until the winding-end parts 62B of the coils 62 are held at the winding-end positioning part 61C of the toroidal core 61. Thus, the winding-end parts 62B can be positioned accurately with respect to the toroidal core 61. The coils 62 are then directed to another end face opposite to the end face 61A, and are pulled radially outwardly. Thus, the coils 62 are completely wound over the toroidal core 61.

In the coil winding portion 60, the winding-start positioning part 61B and the winding-end positioning part 61C are provided in the first and second positioning grooves 61*a* and 61*b* spaced away from each other. The winding-start parts 62A positioned at the winding-start positioning part 61B can be spaced apart from the winding-end parts 62B positioned at the winding-end positioning part 61C. Hence, mutual contact between the winding-start part 62A and winding-end part 62B can be prevented.

A coil unit according to a fourth embodiment of the present invention will be described with reference to FIGS. 14 and 15. The coil unit 7 is a common-mode choke coil and includes a coil winding portion 70 and a case 2 made from a resin. The coil winding portion 70 includes a toroidal core 71 and two coils 72, 72. Each coil 72 is covered with an insulating coating.

The coils 72 are identical to the coils 12 of the first embodiment. The coils 72 are wound over the toroidal core 71, starting at their winding-start parts 72A and ending at their winding-end parts 72B, thus providing a bifilar winding.

Figure 14:
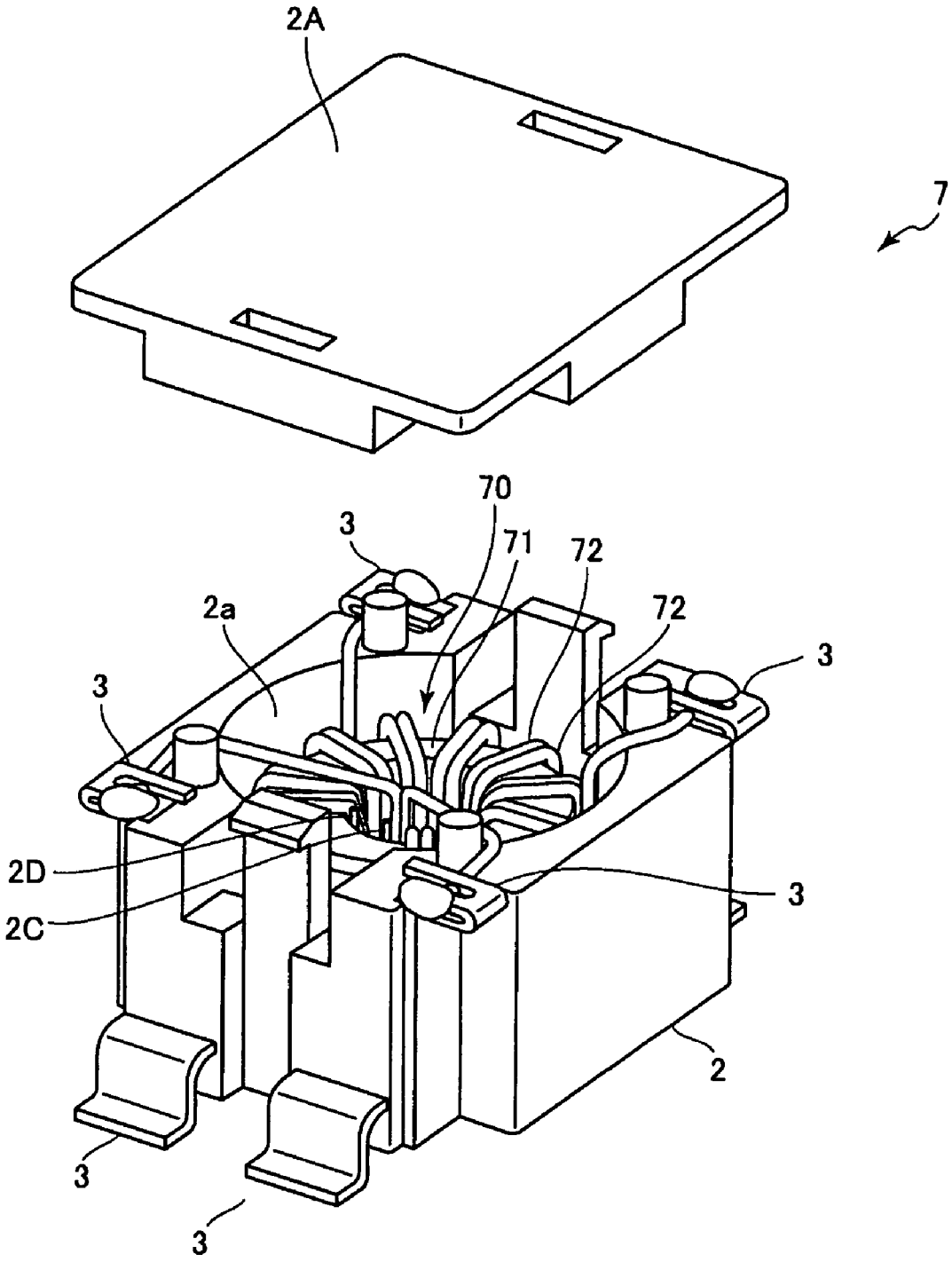
FIG. 14 is an exploded perspective view of a coil unit according to a fourth embodiment of the present invention.

As seen from FIG. 14, the case 2 is similar in configuration to the case 2 of the first embodiment. Therefore, only the portions different from those of the case 2 of the first embodiment will be described. The case 2 is formed with a columnar recess 2*a* at a central portion thereof. The recess 2*a* is open at a top surface of the case 2, and the coil winding portion 70 is accommodated in the recess 2*a*. In the recess 2*a*, a first positioning member 2C and a second positioning member 2D extend approximately parallel to an axis of the recess 2*a* from a bottom surface of the recess 2*a*. The first and second positioning members 2C and 2D are positioned close to each other and at positions in conformance with an inner peripheral surface of the toroidal core 71 when the latter is accommodated in the recess 2*a*.

Figure 15:
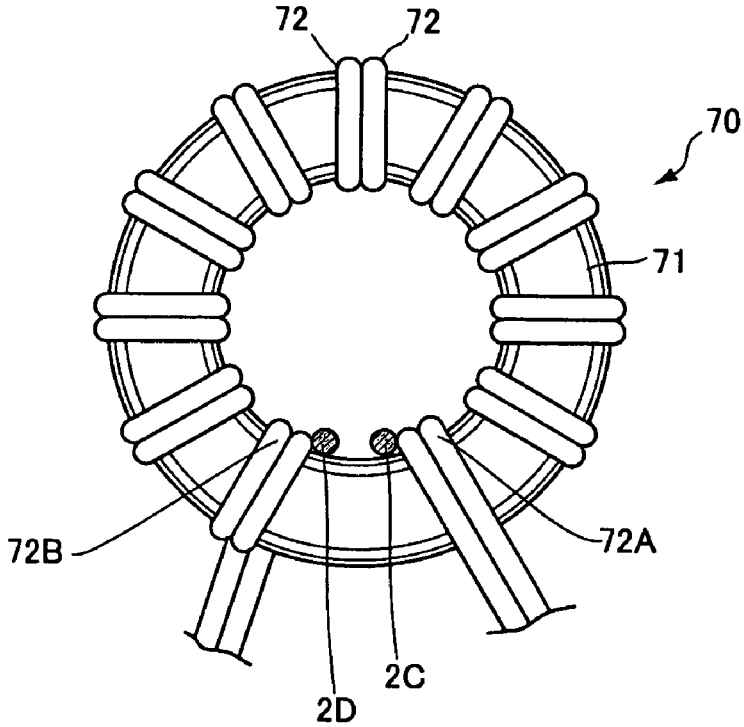
FIG. 15 is a plan view of a coil winding portion of the coil unit according to the fourth embodiment; and, FIG. 16 is a plan view of a coil winding portion of a coil unit according to a modification to the fourth embodiment.

As long as the coil winding portion 70 remains in the case 2, the first positioning member 2C contacts the inner peripheral surface of the core 71 as is illustrated in FIG. 15. Further, the winding-start parts 72A are in contact with a side of the first positioning member 2C, the side being remote from the second positioning member 2D in the circumferential direction of the toroidal core 71. Therefore, the first positioning member 2C accurately positions the winding-start parts 72A on the toroidal core 71. In other words, the winding-start parts 72A are prevented from moving from the first positioning member 2C toward the second positioning member 2D.

The second positioning member 2D contacts the inner peripheral surface of the toroidal core 71. The winding-end parts 72B are in contact with a side of the second positioning member 2D, the side being remote from the first positioning member 2C in the circumferential direction of the toroidal core 71. Therefore, the second positioning member 2D accurately positions the winding-end part 72B on the toroidal core 71. In other words, the winding-end parts 72B are prevented from moving from the second positioning member 2D toward the first positioning member 2C. As a result, a spaced apart relationship between the winding-start parts 72A and the winding-end parts 72B can be maintained.

Figure 16:
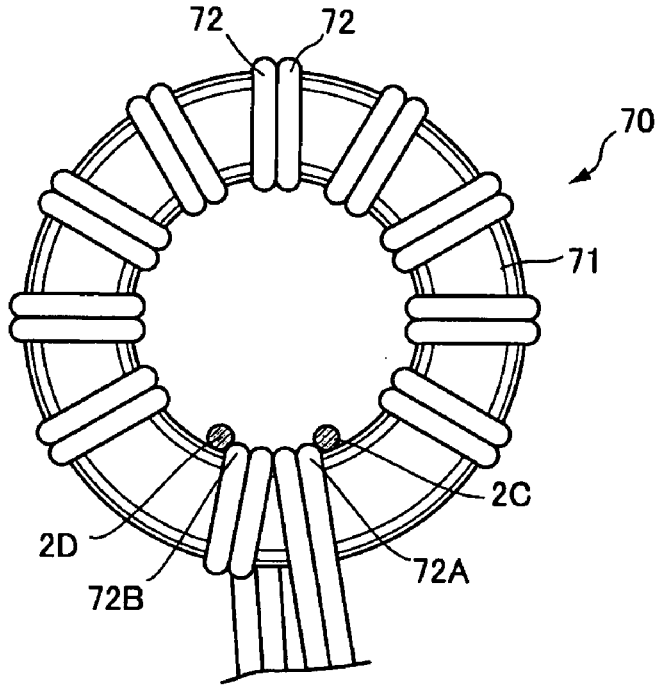

In the fourth embodiment, the winding-start parts 72A and the winding-end parts 72B are positioned spaced away from each other by the first and second positioning members 2C, 2D. Instead, the winding-start parts 72A and the winding-end parts 72B can be positioned in contact with each other by positioning these parts 72A and 72B between a gap defined between the first and second positioning members 2C and 2D as shown in FIG. 16.

The foregoing embodiments pertains coil units each including the coil winding portion and case. Nevertheless, the present invention is also available for a coil unit where the case is dispensed with, that is, the invention is available for the winding portion including the toroidal core and coils.

While the invention has been described in detail and with reference to specific embodiments thereof, it would be apparent to those skilled in the art that various changes and modifications may be made therein without departing from the spirit and scope of the invention.

The invention claimed is:

1. A common mode choke coil comprising:

a toroidal core having an annular shape;

two coils wound over the toroidal core in a circumferential direction thereof to form a bifilar winding, the coils having a winding-start portion and a winding-end portion with respect to the toroidal core; and a positioning portion defining a winding-start positioning part and a winding-end positioning part each in contact with the bifilar winding at the winding-start portion and the winding-end portion, respectively, wherein the positioning parts are provided integrally with the toroidal core, wherein the toroidal core has an inner peripheral surface, and wherein the positioning parts comprise a single projection projecting from the inner peripheral surface radially inwardly, the single projection providing a base end having one side and another side arrayed in a circumferential direction of the toroidal core, the one side serving as the winding-start positioning part and the another side serving as the winding-end positioning part.

2. A common mode choke coil comprising:

a toroidal core having an annular shape;

two coils wound over the toroidal core in a circumferential direction thereof to form a bifilar winding, the coils having a winding-start portion and a winding-end portion with respect to the toroidal core; and a positioning portion defining a winding-start positioning part and a winding-end positioning part each in contact with the bifilar winding at the winding-start portion and the winding-end portion, respectively, wherein the positioning parts are provided integrally with the toroidal core, wherein the toroidal core has an end face extending perpendicular to an axis of the toroidal core, and wherein the positioning parts comprise a single projection projecting from the end face in an axial direction of the toroidal core, the single projection providing a base end having one side and another side arrayed in a circumferential direction of the toroidal core, the one side serving as the winding-start positioning part and the another side serving as the winding-end positioning part.

3. A common mode choke coil comprising:

a toroidal core having an annular shape;

two coils wound over the toroidal core in a circumferential direction thereof to form a bifilar winding, the coils having a winding-start portion and a winding-end portion with respect to the toroidal core; and a positioning portion defining a winding-start positioning part and a winding-end positioning part each in contact with the bifilar winding at the winding-start portion and the winding-end portion, respectively, wherein the positioning parts are provided integrally with the toroidal core, wherein the toroidal core has an end face extending perpendicular to an axis of the toroidal core, and wherein the end face is formed with a positioning groove extending in a radial direction of the toroidal core and has one end open to an inner peripheral surface of the toroidal core and another end open to an outer peripheral surface of the toroidal core, the groove having a first side wall, a second side wall and a bottom wall, an intersecting region of the bottom wall and the first side wall serving as the winding-start positioning part, and an intersecting region of the bottom wall and the second side wall serving as the winding-end positioning part.

4. A common mode choke coil comprising:

a toroidal core having an annular shape;

two coils wound over the toroidal core in a circumferential direction thereof to form a bifilar winding, the coils having a winding-start portion and a winding-end portion with respect to the toroidal core; and a positioning portion defining a winding-start positioning part and a winding-end positioning part each in contact with the bifilar winding at the winding-start portion and the winding-end portion, respectively, wherein the positioning parts are provided integrally with the toroidal core, wherein the toroidal core has an end face extending perpendicular to an axis of the toroidal core, and wherein the end face is formed with a first positioning groove and a second positioning groove each extending in a radial direction of the toroidal core and each having one end open to an inner peripheral surface of the toroidal core and another end open to an outer peripheral surface of the toroidal core, first positioning groove serving as the winding-start positioning part, and the second positioning groove serving as the winding-end positioning part.

* * * * *